US006100850A

United States Patent [19]

Utsumi

[11] Patent Number: 6,100,850

[45] Date of Patent: Aug. 8, 2000

[54] ELECTRONIC PRICE LABEL ANTENNA

[75] Inventor: Yoshitaka Utsumi, Kanagawa, Japan

[73] Assignee: NCR Corporation, Dayton, Ohio

[21] Appl. No.: 09/383,550

[22] Filed: Aug. 26, 1999

[51] Int. Cl.[7] ..... H01Q 1/24

[52] U.S. Cl. ..... 343/702; 343/701; 343/846

[58] Field of Search ..... 343/700 MS, 701, 343/702, 841, 846, 850; H01Q 1/24

[56] References Cited

U.S. PATENT DOCUMENTS

| | | | |
|---|---|---|---|
| 4,002,886 | 1/1977 | Sundelin | 235/61.7 R |
| 4,500,880 | 2/1985 | Gomersall et al. | 340/825.35 |
| 4,924,363 | 5/1990 | Kornelson | 362/125 |
| 5,172,314 | 12/1992 | Poland et al. | 364/401 |
| 5,394,159 | 2/1995 | Schneider et al. | 343/700 |
| 5,448,226 | 9/1995 | Failing, Jr. et al. | 340/825.35 |
| 5,598,169 | 1/1997 | Drabeck et al. | 343/701 |
| 5,668,560 | 9/1997 | Evans et al. | 343/702 |
| 5,794,211 | 8/1998 | Goodwin, III et al. | 705/23 |

*Primary Examiner*—Don Wong
*Assistant Examiner*—Shih-Chao Chen
*Attorney, Agent, or Firm*—Paul W. Martin

[57] ABSTRACT

An electronic price label antenna which is separate from a printed circuit board and which requires only two solder points to connect it to the printed circuit board area. The antenna is a folded metal conductor of the Inverted-F antenna type and includes a ground plane portion separate from the printed circuit board, a radiator portion of lesser width than the ground plan portion, a first side portion on a first side of the ground plane portion which joins the ground plane portion and the radiator portion at a first end of the ground plane portion to form a closed end of the radiator portion, a second side portion on a second side of the ground plane portion which shields the antenna from a display in the electronic price label, a third side portion on a third side at a second end of the ground plane portion which forms an electric field polarization generally oriented along the length of the ground plane portion, a first conductive strip which electrically couples the ground plane portion to a printed circuit board within the electronic price label through a first solder point, and a second conductive strip which electrically couples the radiator portion to the printed circuit board at a second solder point to form an antenna port.

6 Claims, 4 Drawing Sheets

ELECTRONIC PRICE LABEL ANTENNA

BACKGROUND OF THE INVENTION

The present invention relates to electronic price label (EPL) systems, and more specifically to an electronic price label antenna.

EPL systems typically include a plurality of EPLs for merchandise items in a transaction establishment. EPLs typically display the prices of corresponding merchandise items on store shelves and are typically attached to a rail along the leading edge of the shelves. A transaction establishment may contain thousands of EPLs to display the prices of the merchandise items. The EPLs are coupled to a central server from where information about the EPLs is typically maintained in an EPL data file. Price information displayed by the EPLs is obtained from a price look-up (PLU) data file and stored within an EPL price change record. An example of an EPL is disclosed in U.S. Pat. No. 5,668,560, which is assigned to the assignee of the present invention. This patent is hereby incorporated by reference.

EPLs must be low in price. Previous antenna designs require a large printed circuit board area for a ground plane implementation. Previous antenna designs also require multiple number of folded metal components, such as a radiator and a shield-wall. Previous antenna designs also require numerous solder points, especially for assembling a shield-wall.

Therefore, it would be desirable to provide an antenna for an EPL which requires less printed circuit board area, a single folded metal component which provides multiple functions, and fewer solder points, in order to minimize cost of manufacture.

SUMMARY OF THE INVENTION

In accordance with the teachings of the present invention, an electronic price label (EPL) antenna is provided.

The antenna includes a generally planar ground plane portion having a length and width;

a generally planar radiator portion having a length and width and oriented generally parallel to the ground plane portion;

wherein the width of the ground plane portion is larger than the width of the radiator portion;

a generally planar first side portion on a first side of the generally planar ground plane portion which joins the generally planar ground plane portion and the generally planar radiator portion at a first end of the generally planar ground plane portion to form a closed end of the radiator portion;

a generally planar second side portion on a second side of the generally planar ground plane portion opposite the first side portion which shields the antenna from a display in the EPL;

a generally planar third side portion on a third side at a second end of the generally planar ground plane portion which forms an electric field polarization generally oriented along the length of the ground plane portion;

a first conductive strip which electrically couples the ground plane portion to a printed circuit board within the EPL through a first solder point; and a second conductive strip which electrically couples the radiator portion to the printed circuit board at a second solder point to form an antenna port;

wherein only two solder points are required to attach the antenna to the printed circuit board.

It is accordingly an object of the present invention to provide an EPL antenna.

It is another object of the present invention to provide an improved EPL antenna design which requires less printed circuit board area.

It is another object of the present invention to provide an improved EPL antenna design which requires single folded metal component which provides multiple functions.

It is another object of the present invention to provide an improved EPL antenna design which requires fewer solder points.

It is another object of the present invention to provide an improved EPL antenna design which allows EPL housing thickness to be reduced to about 7 mm to 9 mm.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

DETAILED DESCRIPTION OF THE PREFERRED EMBODIMENT

Figure 1:
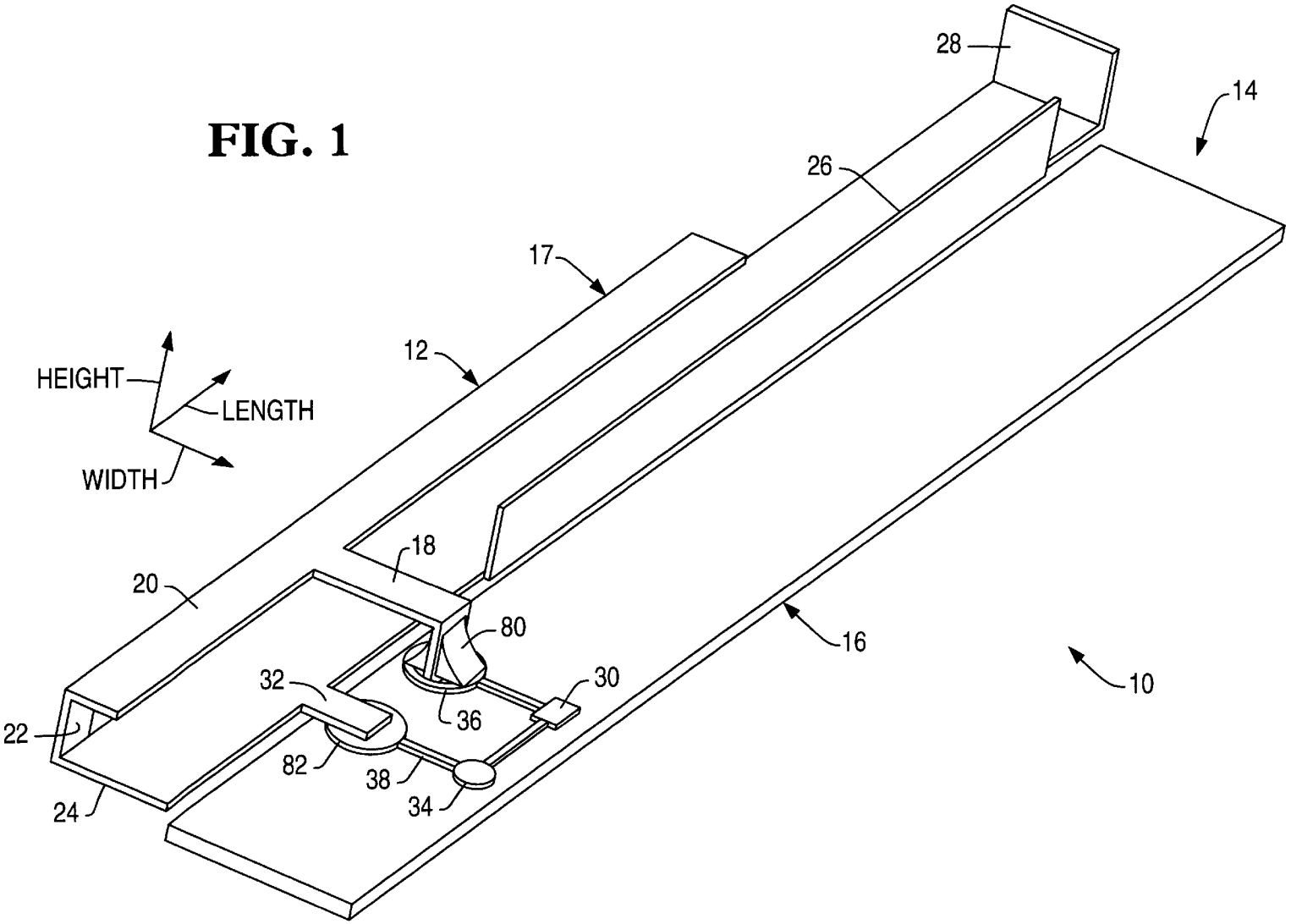
FIG. 1 is a perspective view of the EPL antenna and a circuit board with communication circuitry.
Figure 2:
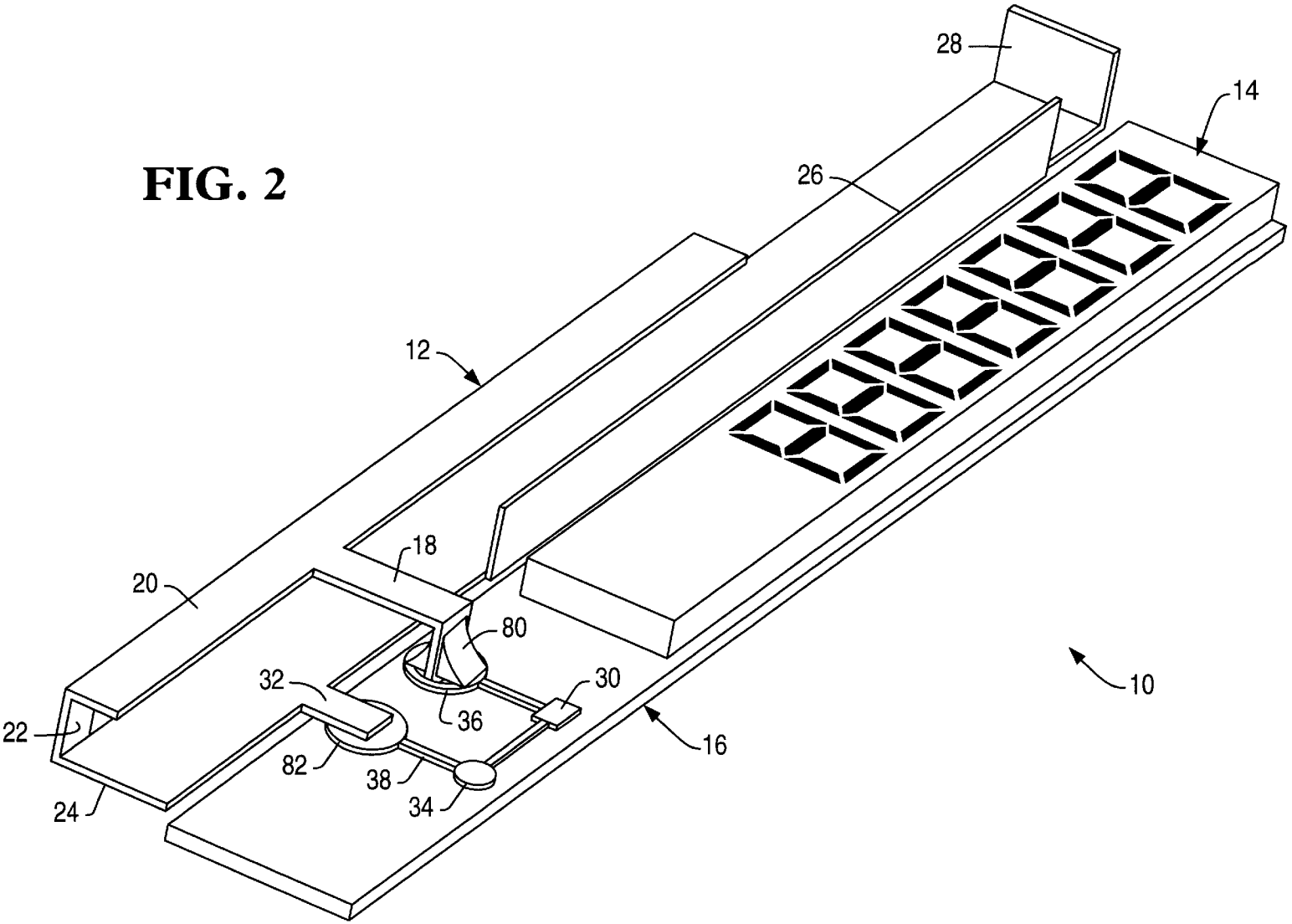
FIG. 2 is a perspective view of the EPL antenna, the circuit board, and a display.

Referring to FIGS. 1 and 2, electronic price label 10 includes antenna 12, display 14 (FIG. 2), and printed circuit board 16.

Antenna 12 is an air dielectric Inverted-F antenna, implemented as a folded planar conductor 17. Antenna 12 includes strip 18, top planar conductor 20, first side planar conductor 22, bottom planar conductor 24, second side planar conductor 26, and third side planar conductor 28.

Strip 18 extends from top planar conductor 20 and acts as an electrical link between top planar conductor 20 and printed circuit board 16, and maintains conductor 20 at a predetermined height above ground plane 24. Strip 18 is generally L-shaped with the bottom end of strip 18 forming an antenna port 36 for passing a received signal to communication circuitry 30. Strip 18 is about 6 mm in width, about 2.5 mm in length, and after the bend, about 4 mm in height. Strip 18 leaves top planar conductor 20 perpendicularly at about 17 mm from end closest to conductor 22.

Top planar conductor 20 acts as a radiator of antenna 12. Top planar conductor 20 is about 54 mm long by about 4 mm wide. Top planar conductor 20 is oriented substantially perpendicularly to first side planar conductor 22.

First side planar conductor 22 is electrically connected or shorted to bottom planar conductor 24 and is oriented substantially perpendicularly at one end of bottom planar conductor 24. First side planar conductor 22 maintains antenna 12 at a predetermined height above bottom planar conductor 24, and acts as a closed-end point of radiator top planar conductor 20. First side planar conductor 22 is about 2.5 mm long by about 5 mm high.

Bottom planar conductor 24 acts as a ground plane of antenna 12 and is electrically connected to the common ground of communication circuitry 30 through ground strip 32. Bottom planar conductor 24 is substantially parallel to top planar conductor 20. Bottom planar conductor 24 is about 70 mm long by about 8 mm wide.

Second and third side planar conductors 26 and 28 extend from bottom planar conductor 24 and also act as corner reflectors which enhance the performance of antenna 12. Second side planar conductor 26 is located at an opposite side of bottom planar conductor 24 from first side planar conductor 22. Since a shield effect against electric field disturbance from display 14 cannot be achieved by using only a flat ground plane, second side planar conductor 26 provides a shielding function against electromagnetic disturbance from display 14. Second side planar conductor 26 is in close proximity to display 14 to provide more space for radiation around top planar conductor 20. Second side planar conductor 26 is about 48 mm long by about 5 mm high.

Third side planar conductor 28 is located at an opposite end of bottom planar conductor 24 from first side planar conductor 22. Since antenna 12 has its electric field polarity along the "length" axis, a large extension of bottom planar conductor (ground plane) 24 in this direction, and toward the side of the open-end of top planar conductor 20, as much as possible, is desirable for better antenna performance. However, since EPL housing size is typically limited in the length direction, third side planar conductor 28 must be bent upwards from bottom planar conductor (ground plane) 24. This additional ground plane area provides better antenna performance. Third side planar conductor 28 is about 8 mm wide by about 5 mm high.

Antenna 12 has an operating frequency of about 2.45 GHz. Antenna 12 uses the air gap between top planar conductor 20 and bottom planar conductor 24 as a dielectric. The length between the open end of top planar conductor 20 and strip 18 (about 37 mm) together with the height of first side planar conductor 22 (about 5 mm) determine the resonant frequency of antenna 12.

The length between the closed end of top planar conductor 20 and strip 18 (about 17 mm), the length and height of first side planar conductor 22 (about 2.5 mm and 5 mm, respectively) and the length, width and height of strip 18 (about 2.5 mm, 6 mm, and 4 mm, respectively) determine the impedance of antenna port 36.

The width and height of top planar conductor 20 determines bandwidth.

The present design has some advantage in directivity due to the corner reflector effect from third side planar conductor 28. Again, antenna 12 has an electric field polarity oriented along the length axis.

Antenna 12 may be fabricated from a stainless or cold-rolled steel to a thickness of about 0.2 mm. The steel is then bent, resulting in antenna 12 having the shape illustrated in FIG. 1.

Printed circuit board 16 has a thickness of about 1 mm. Communication circuitry 30 is shown as a single element to simplify the drawings, but actually employs much of the area of printed circuit board 16. Communication circuitry 30 is preferably wireless communication circuitry which operates using wireless backscatter communication techniques.

Printed circuit board 16 sits adjacent antenna 12. Since bottom planar conductor 24 acts as the ground plane, printed circuit board 16 area is minimized.

Printed circuit board 16 additionally includes power supply 34, which is preferably a battery.

Strip 18 connects to communication circuitry 30 through electrical traces 38 to form an antenna port 36 for antenna 12. Antenna port 36 is a soldering pad on printed circuit board 16 and connects to electrical traces 38. Advantageously, printed circuit board 16 includes only two solder points 80 and 82, point 80 at antenna port 36 and point 82 at ground strip 32.

Figure 3:
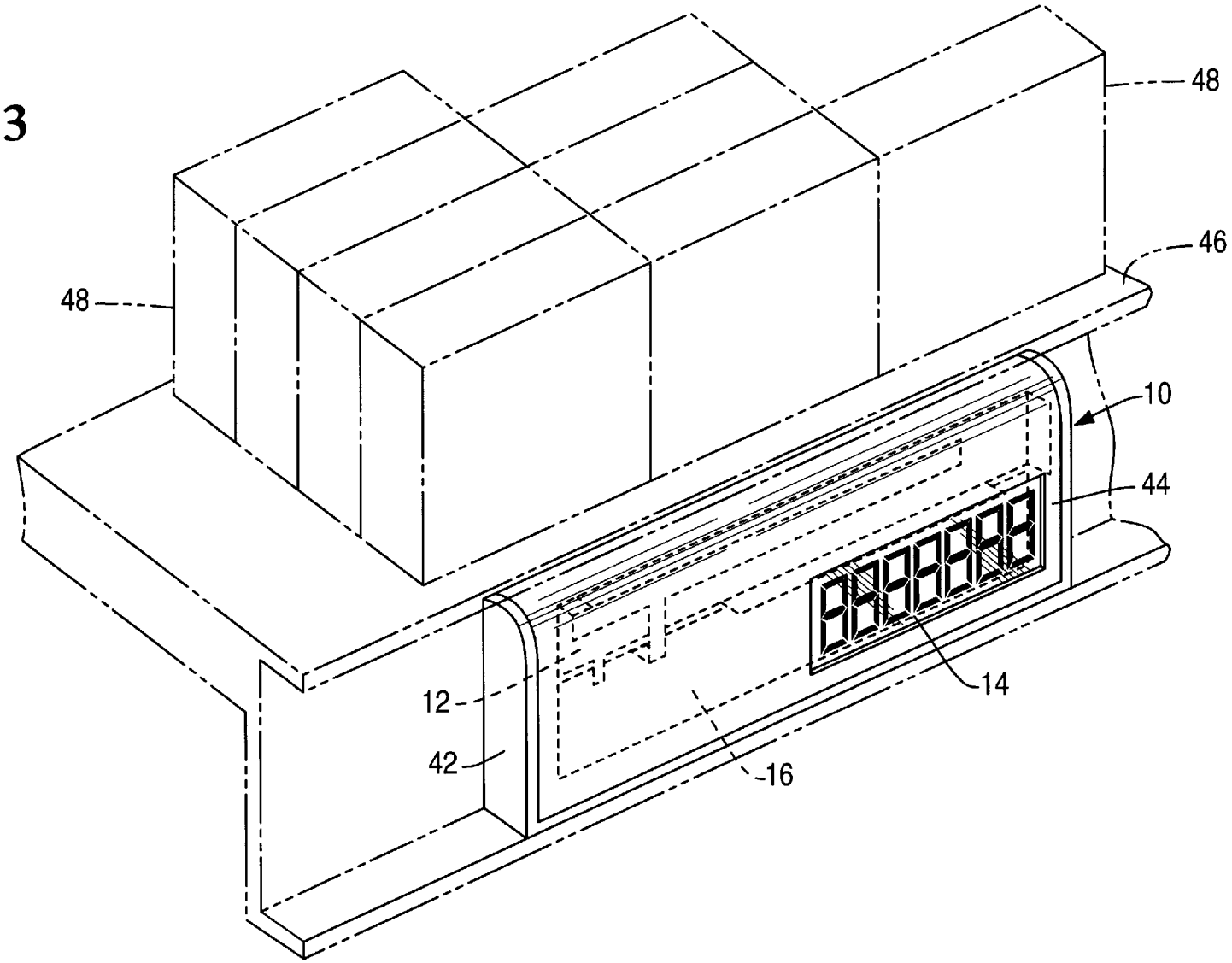
FIG. 3 is a perspective view of an EPL containing the components of FIG. 2.

Turning now to FIG. 3, antenna 12, printed circuit board 16, and display 14 of electronic price label 10 are shown.

Electronic price label 10 further includes housing 42 and overlay 44. Housing 42 can be made smaller in height, to no more than about 7 mm to 9 mm, using antenna 12. Housing 42 fits within a suitable mount on the edge of shelf 46 where items 48 are arranged.

Overlay 44 typically uses as much frontal surface area of housing 42 as is practical for displaying static information.

Figure 4:
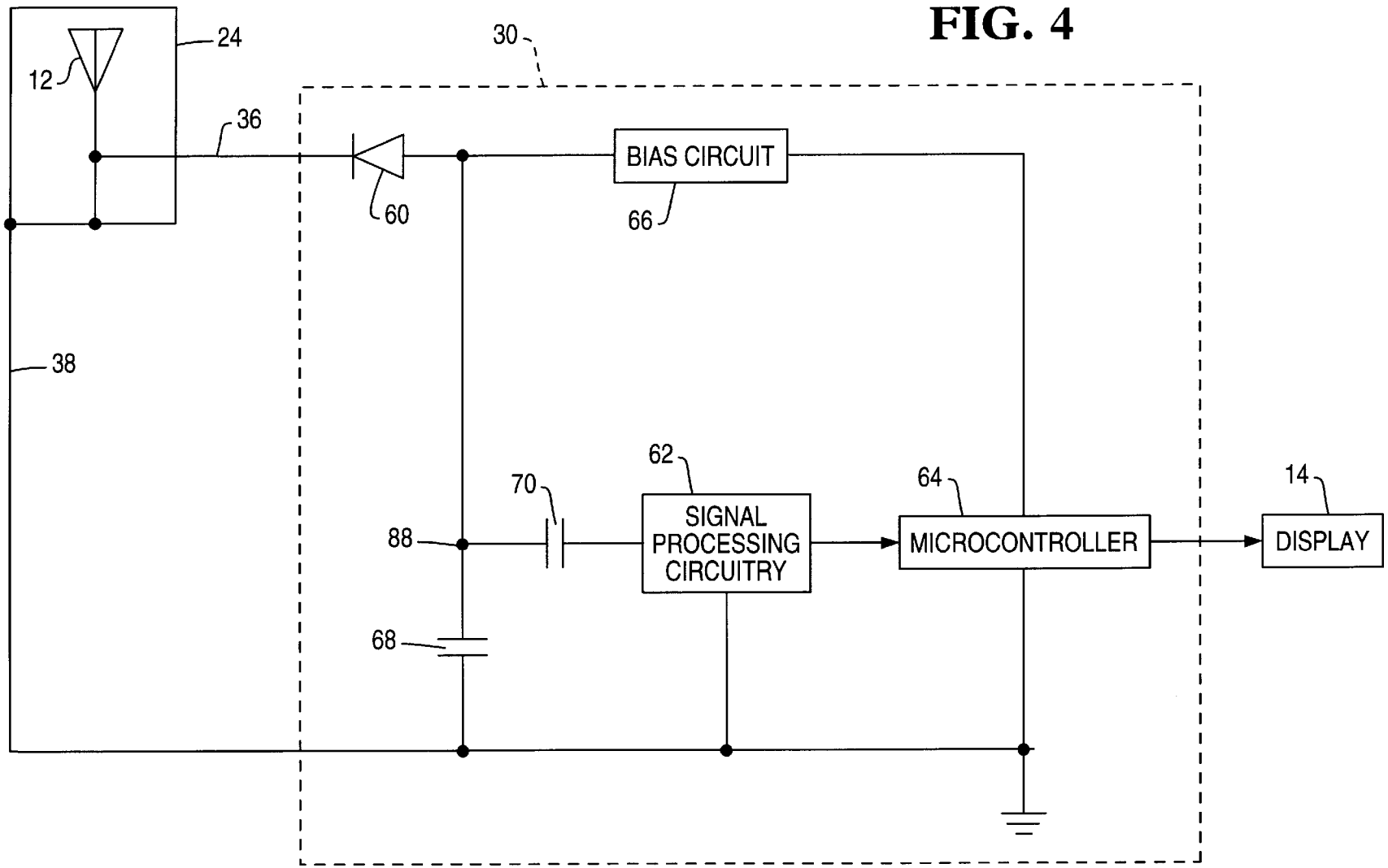
FIG. 4 is a circuit diagram of the EPL.

Turning now to FIG. 4, a signal incident on antenna 12 generates an RF voltage between antenna port 36 and bottom planar conductor 24. This RF voltage is resonated and detected by detector 60 in communication circuitry 30. Antenna 12 is designed to have a port impedance that is inductive to conjugately match the capacitive impedance of detector 60.

Communication circuitry 30 includes detector 60, signal processing circuitry 62, microcontroller 64, and bias control circuit 66.

Detector 60 is preferably a Schottky barrier-type silicon diode. Detector 60 couples to data port 88 at the junction of capacitance 68 and capacitance 70.

Capacitance 68 is a quarter-wave transmission line or RF open-circuit stub or discrete capacitor component which shorts out the radio frequency signal after it is detected by detector 60.

Capacitance 70 is a discrete component between detector 60 and signal processing circuitry 62.

Operation is similar to the EPL disclosed in the previously incorporated U.S. Pat. No. 5,668,560. A modulated RF signal is received by antenna 12. Because of the series resonance of antenna 12 and diode 60, all of the detected RF signal appears across capacitance 68. Capacitance 70 couples the resulting signal to signal processing circuitry 62. Signal processing circuitry 62 amplifies the detected RF signal and detects on/off keyed data bits in the amplified RF signal. Microcontroller 64 processes the data bits to generate data for display by display 14. Microcontroller 64 also controls bias circuit 66 which controls a bias current and impedance of detector 60.

Advantageously, antenna 12 reduces cost because it uses a smaller printed circuit board area by transferring its ground plane area from an expensive printed circuit board to a cheap sheet of metal. Also antenna 12 reduces component count of folded metal which enables less material handling cost. Assembly is also easier, since a single sheet of metal and only two solder points are necessary.

Although the present invention has been described with particular reference to certain preferred embodiments thereof, variations and modifications of the present invention can be effected within the spirit and scope of the following claims.

What is claimed is:

1. An antenna for an electronic price label (EPL) comprising:

a generally planar ground plane portion having a length and width;

a generally planar radiator portion having a length and width and oriented generally parallel to the ground plane portion;

wherein the width of the ground plane portion is larger than the width of the radiator portion;

generally planar first side portion on a first side of the generally planar ground plane portion which joins the generally planar ground plane portion and the generally planar radiator portion at a first end of the generally planar ground plane portion to form a closed end of the radiator portion;

a generally planar second side portion on a second side of the generally planar ground plane portion opposite the first side portion which shields the antenna from a display in the EPL;

a generally planar third side portion on a third side at a second end of the generally planar ground plane portion which forms an electric field polarization generally oriented along the length of the ground plane portion;

a first conductive strip which electrically couples the ground plane portion to a printed circuit board within the EPL through a first solder point; and a second conductive strip which electrically couples the radiator portion to the printed circuit board at a second solder point to form an antenna port;

wherein only two solder points are required to attach the antenna to the printed circuit board.

2. The antenna as recited in claim 1, wherein a distance between an open end of the radiator portion and the second conductive strip, and a height of the first side portion determine a resonant frequency.

3. The antenna as recited in claim 2, wherein the resonant frequency is a number of GHz.

4. The antenna as recited in claim 1, wherein a distance between the closed end of the radiator portion and the second conductive strip, and a height and length of the first side portion, and a height, length, and width of the first conductive strip determine an impedance of the antenna port.

5. An Inverted-F antenna for an electronic price label (EPL) comprising:

a folded metal conductor including a generally planar and rectangular ground plane portion having a length and width;

a generally planar and rectangular radiator portion having a length and width and oriented generally parallel to the ground plane portion;

wherein the width of the ground plane portion is larger than the width of the radiator portion;

a generally planar and rectangular first side portion on a first side of the generally planar ground plane portion which joins the generally planar ground plane portion and the generally planar radiator portion at a first end of the generally planar ground plane portion;

a generally planar and rectangular second side portion on a second side of the generally planar ground plane portion opposite the first side portion which shields the antenna from a display in the EPL; and a generally planar and rectangular third side portion on a third side at a second end of the generally planar ground plane portion which forms an electric field polarization generally oriented along the length of the ground plane portion;

a first conductive strip which electrically couples the ground plane portion to a printed circuit board within the EPL through a first solder point; and a second conductive strip which electrically couples the radiator portion to the printed circuit board at a second solder point;

wherein only two solder points are required to attach the antenna to the printed circuit board.

6. An electronic price label (EPL) comprising:

a printed circuit board;

a display mounted on the printed circuit board; and a folded metal antenna separate from the printed circuit board including a generally planar ground plane portion having a length and width;

a generally planar radiator portion having a length and width and oriented generally parallel to the ground plane portion;

wherein the width of the ground plane portion is larger than the width of the radiator portion;

a generally planar first side portion on a first side of the generally planar ground plane portion which joins the generally planar ground plane portion and the generally planar radiator portion at a first end of the generally planar ground plane portion;

a generally planar second side portion on a second side of the generally planar ground plane portion opposite the first side portion which shields the antenna from a display in the EPL;

a generally planar third side portion on a third side at a second end of the generally planar ground plane portion which forms an electric field polarization generally oriented along the length of the ground plane portion;

a first conductive strip which electrically couples the ground plane portion to a printed circuit board within the EPL through a first solder point; and a second conductive strip which electrically couples the radiator portion to the printed circuit board at a second solder point;

wherein only two solder points are required to attach the antenna to the printed circuit board.

* * * * *